US006390836B1

(12) United States Patent
Motegi et al.

(10) Patent No.: US 6,390,836 B1
(45) Date of Patent: May 21, 2002

(54) CARD CONNECTOR

(75) Inventors: Shinichi Motegi, Tokyo; Shigeru Sato, Chiba, both of (JP)

(73) Assignee: Yamaichi Electronics Co., Ltd., Tokyo (JP)

( * ) Notice: Subject to any disclaimer, the term of this patent is extended or adjusted under 35 U.S.C. 154(b) by 0 days.

(21) Appl. No.: 09/713,256

(22) Filed: Nov. 16, 2000

(51) Int. Cl.[7] ..... H01R 13/62
(52) U.S. Cl. ..... 439/159; 439/188; 439/911
(58) Field of Search ..... 235/441, 482; 439/157, 159, 188, 911

(56) References Cited

U.S. PATENT DOCUMENTS 5,033,972 A * 7/1991 Komatsu et al. ..... 439/153
5,648,651 A * 7/1997 Inoue ..... 235/475

* cited by examiner

*Primary Examiner*—Khiem Nguyen
(74) *Attorney, Agent, or Firm*—Finnegan, Henderson, Farabow, Garrett & Dunner, L.L.P.

(57) ABSTRACT

The card connector has an eject operation detection switch SW arranged to turn on immediately after the ejection button has begun to be pressed, and an eject operation mechanism arranged to, in response to the pressing operation of the ejection button, start a card eject operation after the eject operation detection switch SW has turned on. This card connector reliably avoids a card error even when the ejection button is erroneously operated, thereby preventing a data loss.

3 Claims, 14 Drawing Sheets

CARD CONNECTOR

BACKGROUND OF THE INVENTION

1. Field of the Invention

The present invention relates to a card connector mounted on electronic devices, such as cellular phones, telephones, PDA (personal digital assistance), portable audio devices and digital cameras, and more specifically to a structure for ejecting a card.

2. Description of the Related Art

In electronic devices such as cellular phones, telephones, PDA and digital cameras, a variety of functions are added and the user is identified by inserting an IC card with a built-in IC, including memory or controlled circuit, such as a SIM (subscriber identity module) card, an MMC (multimedia card; trademark) and a Smart Media (trademark) card.

In a connector structure for removably accommodating such an IC card, a plurality of contact terminals, which are connected with various signal processing circuits and a power supply circuit in the electronic device mounting the connector, are provided in a connector housing to make contact with a plurality of contact pads formed on the front or back surface of the inserted IC card to electrically connect the IC card to the electronic device having that connector through the contact between the contact terminal and the contact pad.

Many of such card connectors have an ejection mechanism for ejecting an inserted card from the connector.

A conventional ejection mechanism of this nature has an ejection button member, a slide member slidable relative to the connector body and a cam lever interposed between the ejection button member and the slide member. Upon pressing operation of the ejection button member, the movement of the ejection button member is converted through the cam lever into a motion of the slide member in the ejection direction. That is, the slide member linked to the cam lever is slid in the ejection direction, thereby ejecting the card supported on the slide member out of the connector.

As described above, in the conventional ejection mechanism the operation of the ejection button results in an immediate initiation of the ejection operation of the card, so that when the user erroneously operates the ejection button while the card is being read or written, errors may result giving rise to a possibility of loss of data being written or read.

In the present invention which has been made in consideration of the above circumstances, an object thereof is to provide a card connector that can reliably avoid errors even when the ejection button is pressed inadvertently.

SUMMARY OF THE INVENTION

In one aspect of the present invention, there is provided a card connector which is capable of removably supporting a card and, in response to a pressing operation of an ejection button, ejecting the card inserted in the connector, the card connector comprising: an eject operation detection switch configured to turn on immediately after the eject bottom has begun to be pressed; and an eject operation mechanism configured to, in response to the pressing operation of the ejection button, start the operation of ejecting the card after the eject operation detection switch has turned on.

With this invention, when the ejection button is pressed, the eject operation detection switch turns on before the ejection mechanism starts ejecting the card. Hence, on the electronic device side where the connector is mounted, it is possible to perform a predetermined error avoiding handling according to a detection signal from the eject operation detection switch before the electrical contacts of the card and the connector noncontact. Hence, even when the ejection button is erroneously operated, a card error can be forestalled, thus precluding the possibility of loss of data being written into or read from the card.

In other embodiment of this invention, an automatic reset mechanism is further included which automatically resets the ejection button when not loaded.

Because the ejection button is reset to the initial position when not loaded, the ON/OFF switching of the eject operation detection switch does not occur unless the button is pressed with a load, thus preventing an inadvertent operation of the switch.

The above and other objects, effects, features, and advantages of the present invention will become more apparent from the following description of embodiments thereof taken in conjunction with the accompanying drawings.

DETAILED DESCRIPTION OF PREFERRED EMBODIMENTS

Now, an embodiment of the present invention will be described in detail by referring to the accompanying drawings.

Figure 1:
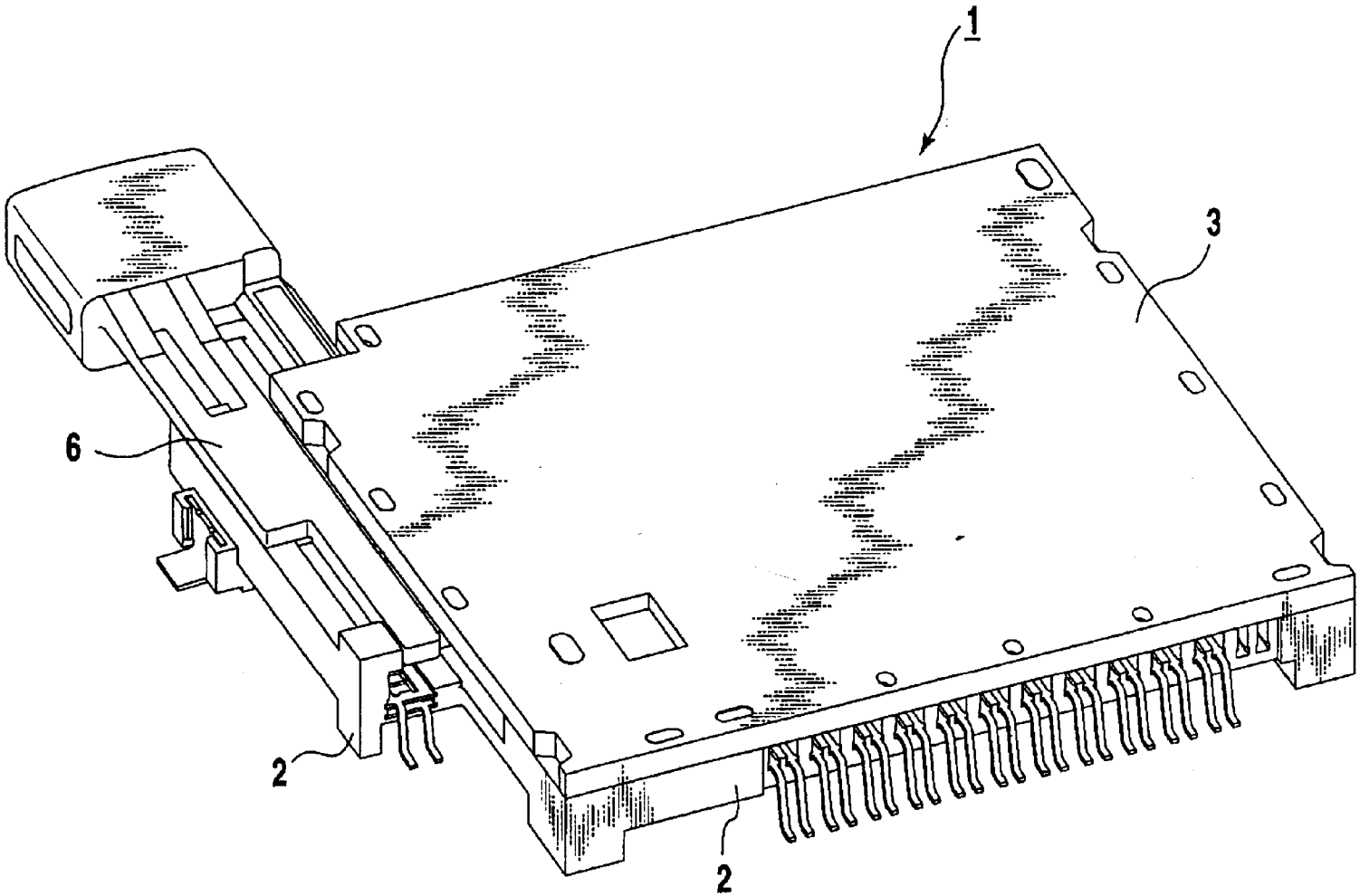
FIG. 1 is a perspective view showing an outline construction of a card connector as one embodiment of this invention.
Figure 2:
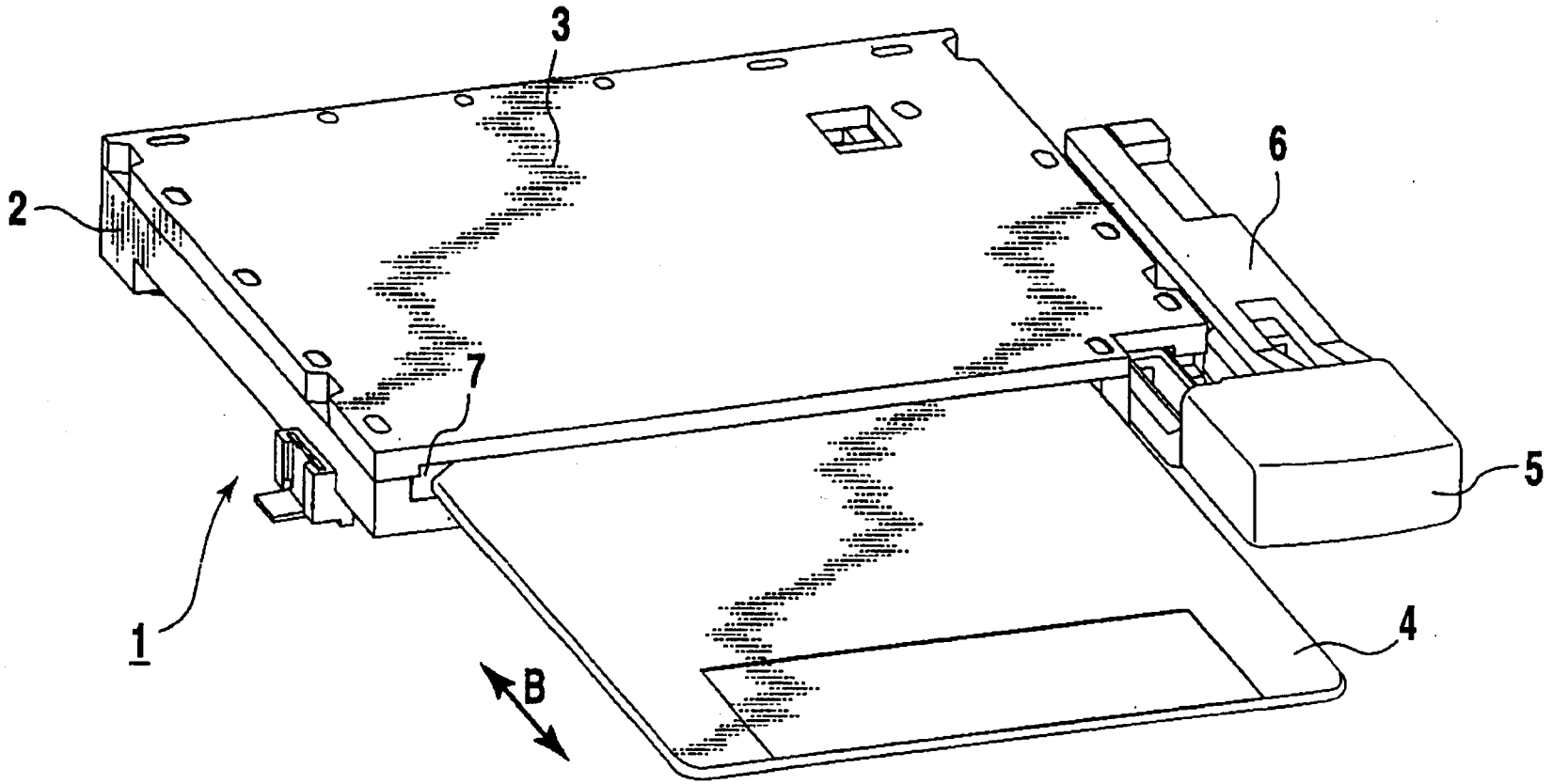
FIG. 2 is a perspective view of the card connector of FIG. 1 as seen from the card insertion side.
Figure 3B:
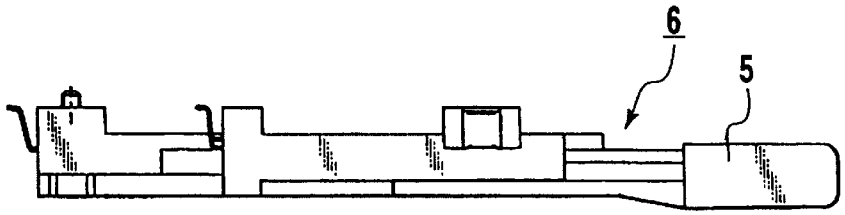
FIG. 3B is a side view as seen from the direction of arrow G of FIG. 3A.
Figure 3A:
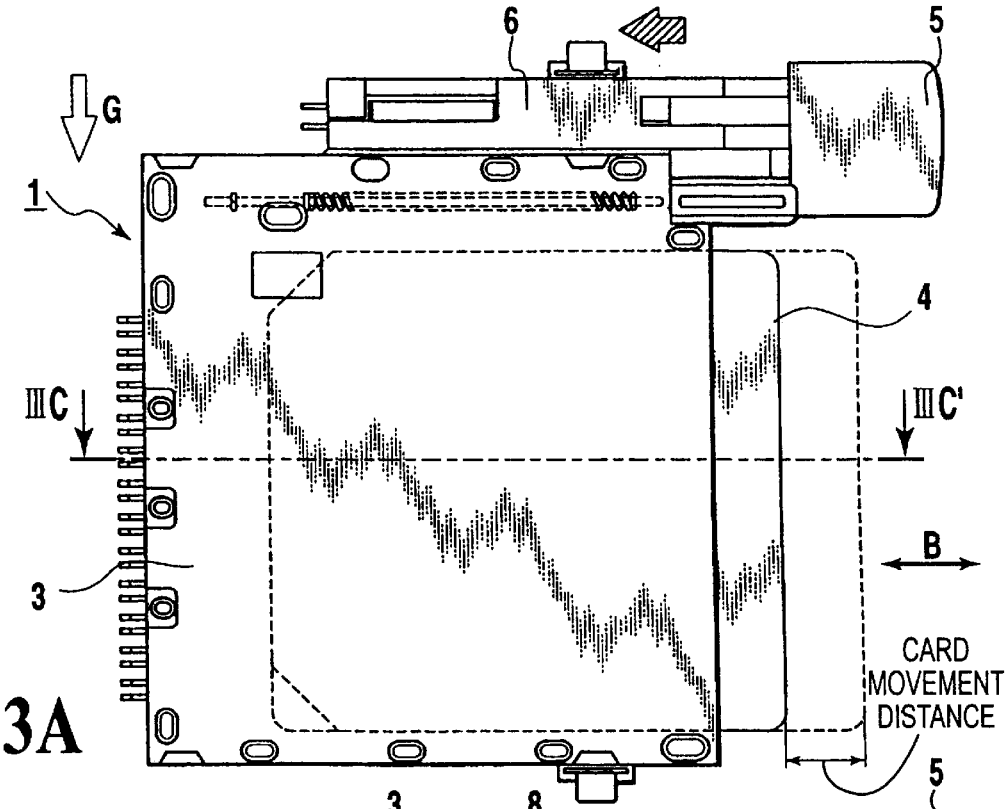
FIG. 3A is a plan view of the card connector of FIG. 1.
Figure 3C:
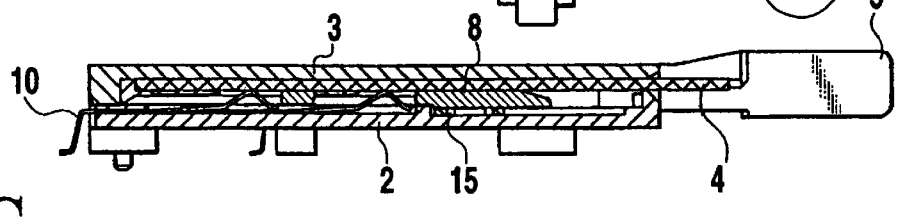
FIG. 3C is a cross section taken along the line IIIC–IIIC' of FIG. 3A.

FIG. 1 and FIG. 2 show external views of a structure of a card connector as seen from different directions. FIG. 3A is a plan view of the card connector, FIG. 3B is a side view of the card connector as seen from the direction of arrow G of FIG. 3A, and FIG. 3C is a cross section taken along the line IIIC–IIIC' of FIG. 3A.

This card connector 1 is mounted on electronic devices such as cellular phones, PDA, portable audio devices and digital cameras.

In FIG. 1 to FIGS. 3A, 3B, 3C, the card connector 1 includes a connector housing which comprises: a housing body 2 mainly forming a lower part of the connector housing; a housing cover 3 mainly forming an upper part of the connector housing; and an eject member 6 arranged at a side portion of the housing body 2 and having at its head an ejection button 5 for ejecting an IC card 4. These members are molded of an insulating material such as resin, respectively.

The IC card 4, as shown in FIG. 2, is inserted into the connector 1 through a card insertion opening 7 formed in a front face of the card connector 1. The card 4 is supported on a slider 8 inside the connector 1. The slider 8 is arranged movable relative to the housing body 2 in a card insertion/retraction direction B. When the slider 8 is slidden by the ejection mechanism described later, the slider 8 slides and ejects the card 4 it carries.

Figure 4:
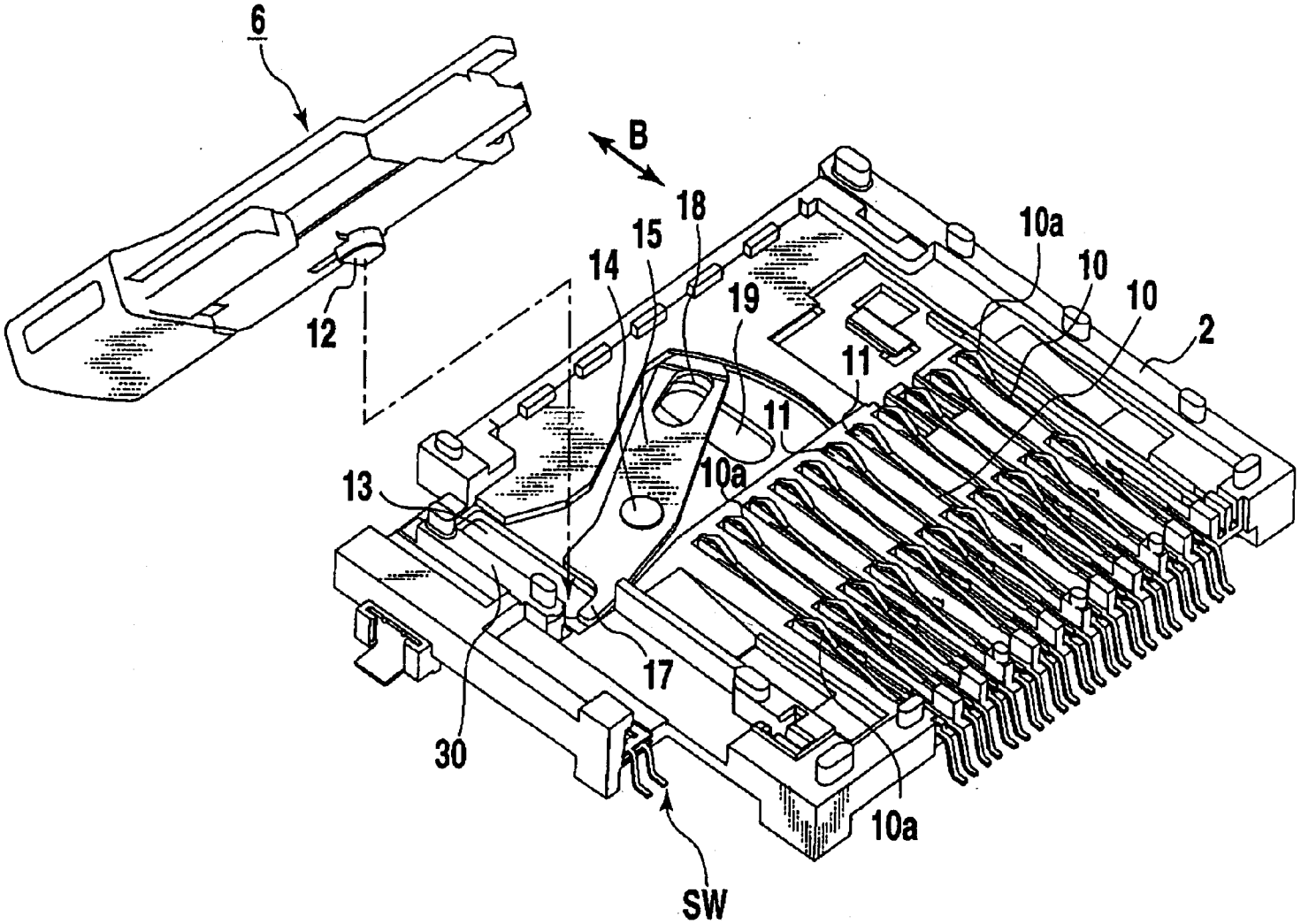
FIG. 4 is a perspective view showing a housing body of the card connector of FIG. 1 and an eject member disassembled from the housing body.

FIG. 4 shows the inner construction of the housing body 2 and how the eject member 6 is assembled onto the housing body 2. In FIG. 4, the slider 8 disposed over the housing body 2 is not shown.

As shown in FIG. 4, the housing body 2 is formed with a plurality of grooves 11 in which a plurality of contact terminals 10 each formed of a leaf spring are positioned and press-fitted. In this case, the contact terminals 10 are arranged in two rows. The contact terminals 10 include a power supply terminal and signal terminals. The contact terminals 10 have contact portions 10*a* projecting from the front end side, through which come in contact with a plurality of contact pads formed on the card 4. The contact terminals 10 are soldered at their base end side to contact pads of a printed circuit board of an electronic device. The slider 8 is formed with a plurality of recessed grooves (not shown) to allow the contact portion 10*a* of each contact terminal 10 of the connector to come in contact with the corresponding contact pad of the card 4 while the card 4 is supported on the slider 8.

The housing body 2 is formed with a guide slot 13 for guiding movement of a boss 12 protruding from the underside of the eject member 6. The boss 12 moves in the guide slot 13 as the eject member 6 moves. On the housing body 2 is provided a cam lever 15 that is rotational about a shaft 14 relative to the housing body 2. The cam lever 15 has a force receiving portion 17 at one end which comes in contact with the boss 12 so that a force is effectively transmitted from the boss 12 to the cam lever 15. At the other end, the cam lever 15 has a slot 18 that inserts a projection 20 (see FIG. 11) protruding from the underside of the slider 8. At a position corresponding to the slot 18, the housing body 2 is formed with a guide slot 19 that guides movement of the projection 20 in the card insertion/retraction direction B.

Figure 5:
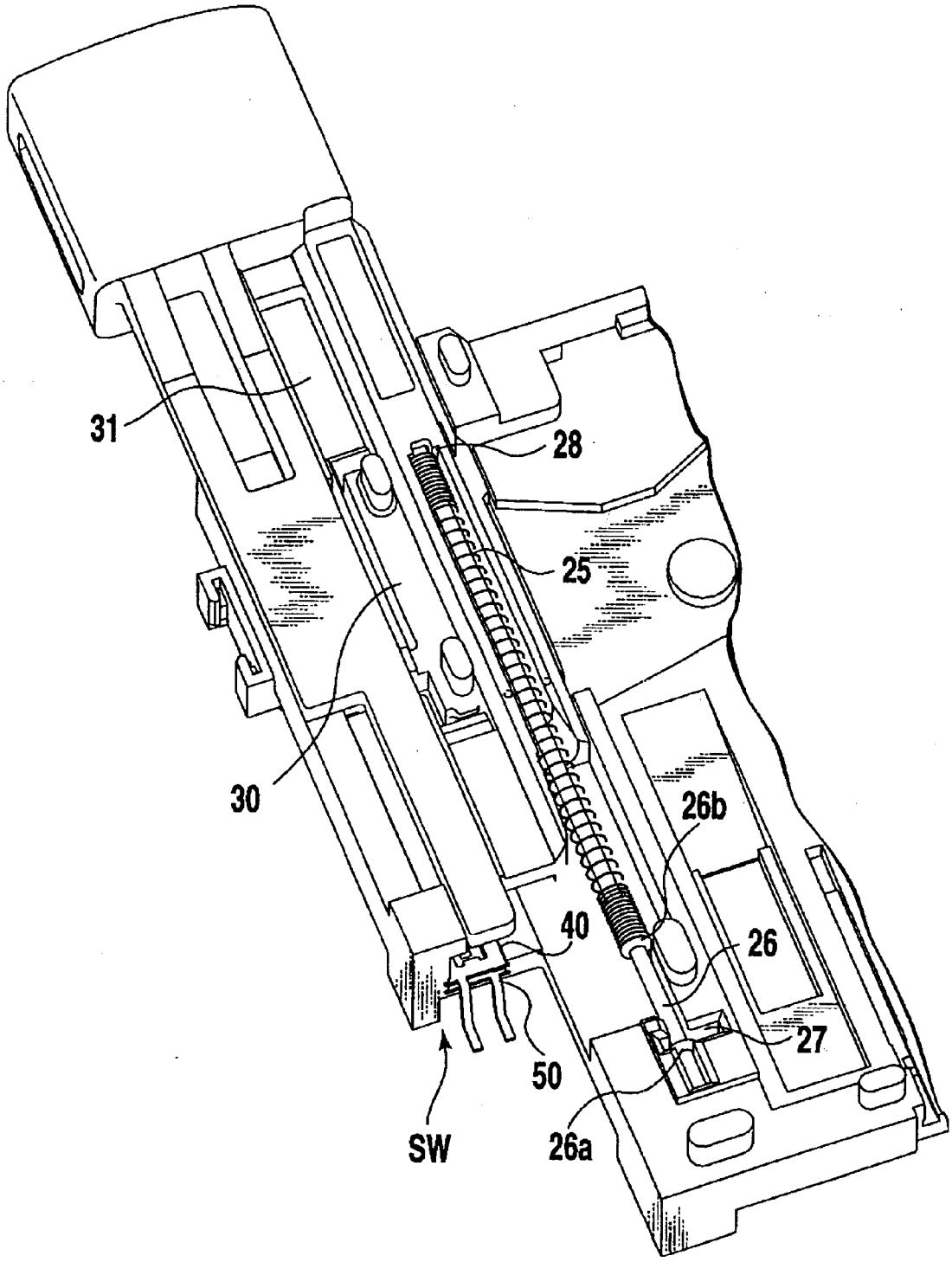
FIG. 5 is a perspective view showing a construction in proximity to the eject member and its associated components in the card connector of FIG. 1.
Figure 6:
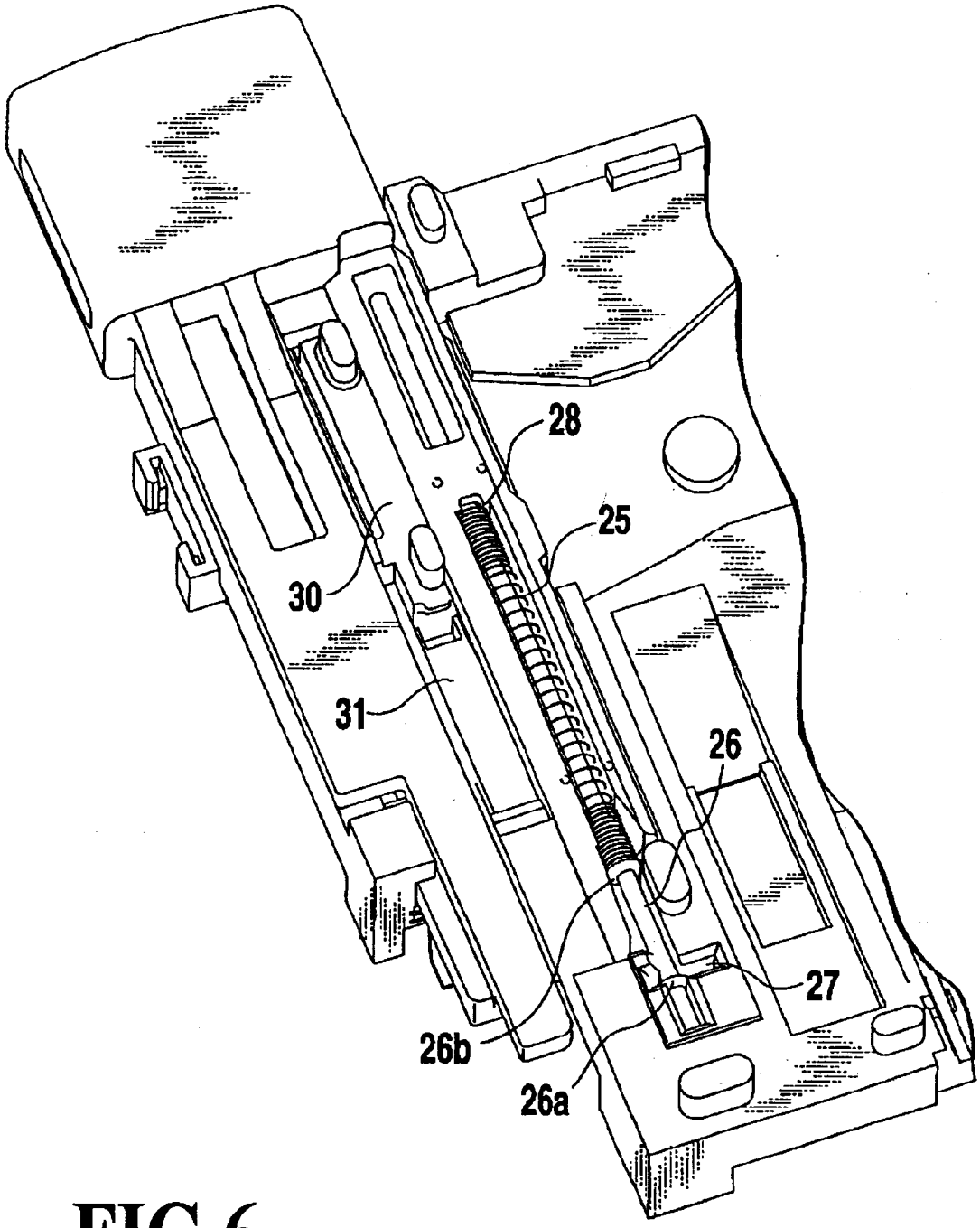
FIG. 6 is a perspective view showing a construction in proximity to the eject member and its associated components in the card connector of FIG. 1.

FIG. 5 and FIG. 6 show the construction of the eject member 6 neighborhood and associated components, with FIG. 5 representing the state before the ejection button 5 is pressed and FIG. 6 representing the state after the ejection button 5 is pressed.

In FIG. 5 and FIG. 6, the housing body 2 is formed with a groove 27 for positioning a large-diameter portion 26*a* of a guide pin 26, which guides a coil spring 25 as it expands and compresses. At a portion of the housing body 2 where the large-diameter portion 26*a* of the guide pin 26 is mounted and at a portion of the housing body 2 corresponding to the other end of the guide pin 26, there are slightly raised base portions (not shown). Between these raised base portions the guide pin 26 is bridged across.

The guide pin 26 passes through the coil spring 25 which has end turn at each end. One end of the coil spring 25 comes in contact with a large-diameter portion 26*b* formed at a predetermined position on the guide pin 26, and the other end comes in contact with a spring touching surface 28 of the eject member 6 to urge the eject member 6 in a return direction by the recovery force of the coil spring 25.

Hence, after the eject member 6 is pushed against the elasticity force of the coil spring 25 from the state of FIG. 5 to the state of FIG. 6, releasing the pressing force allows the eject member 6 to automatically return to the state of FIG. 5 by the recovery force of the coil spring 25.

As shown in FIG. 4, the housing body 2 is formed with a stopper body 30 projecting upward which restricts a range of movement of the eject member 6. The eject member 6 is formed with a guide slot 31 that the stopper body 30 is inserted. The combination of the stopper body 30 and the guide slot 31 allows the eject member 6 to move between the positions shown in FIG. 5 and FIG. 6.

At one side of the upper surface of the housing body 2 is arranged an eject operation detection switch SW made up of a pair of metal pieces 40, 50.

Figure 7:
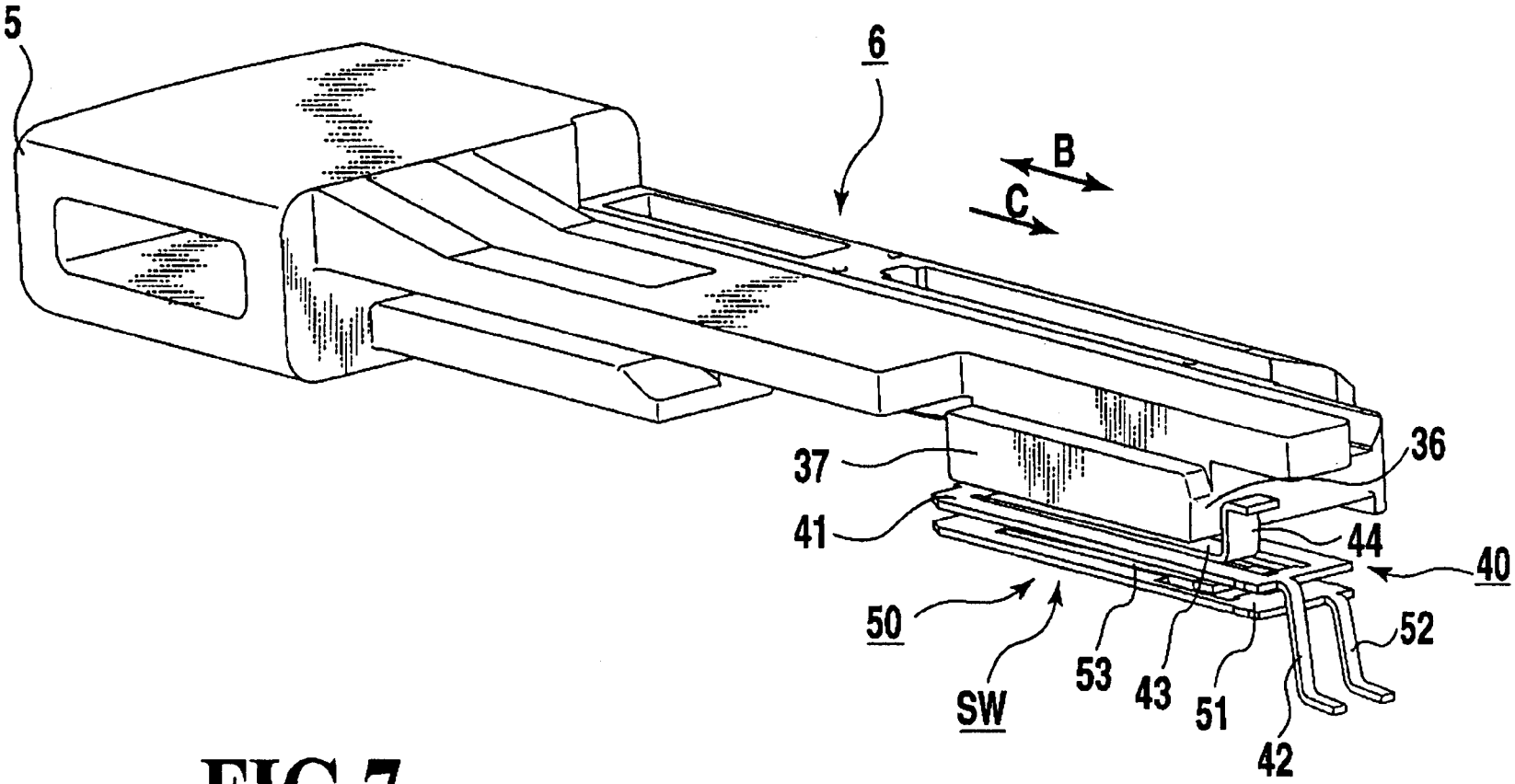
FIG. 7 is a perspective view showing a positional relation between the eject member and an eject operation detection switch in the card connector of FIG. 1.

FIG. 7 shows a positional relation between the eject operation detection switch SW and the eject member 6.

Figure 8:
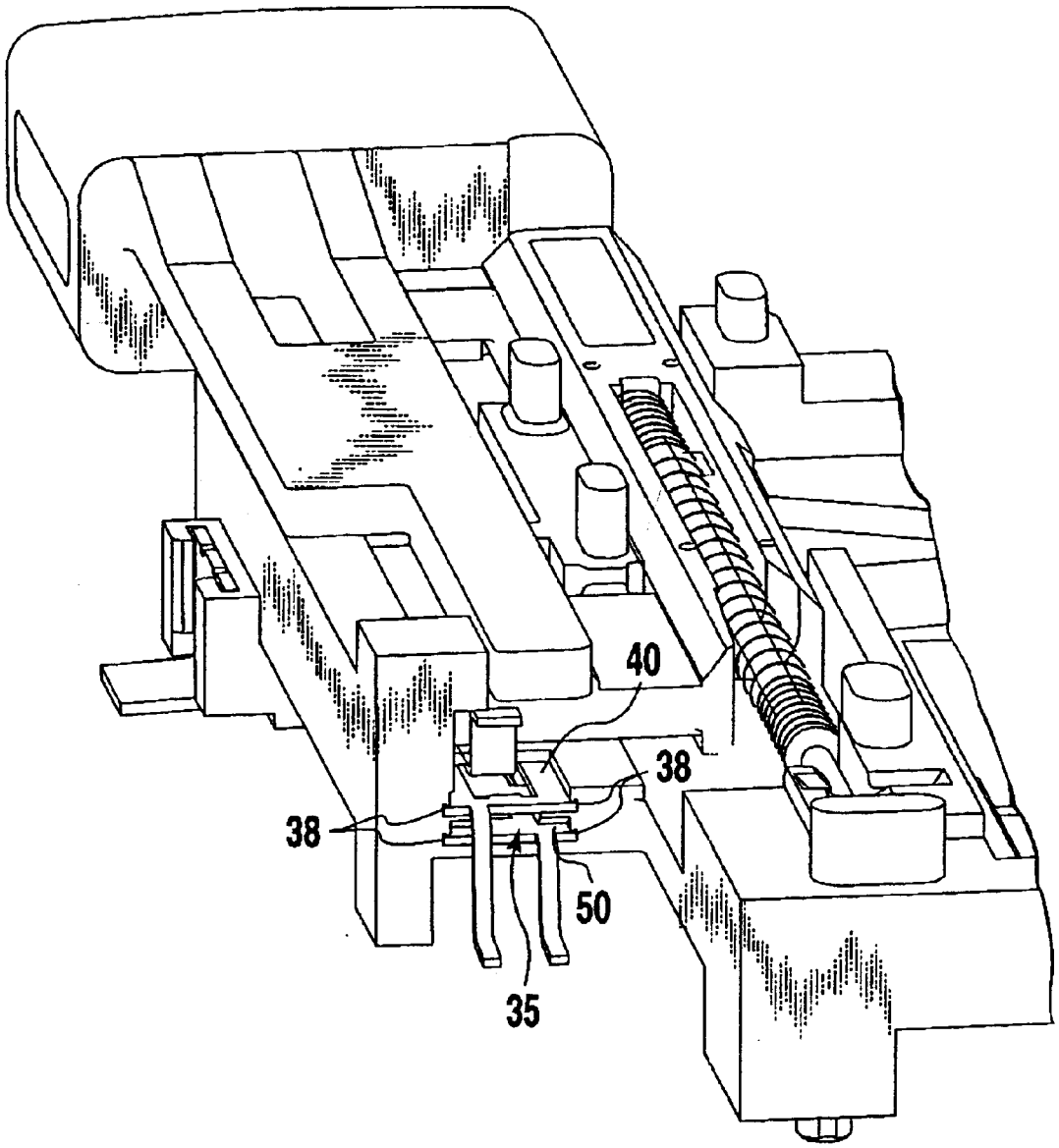
FIG. 8 is a perspective view showing a positional relation between the eject member and an eject operation detection switch in the card connector of FIG. 1.

A pair of metal pieces 40, 50 forming the eject operation detection switch SW, as shown in FIG. 8, are fixed in the housing body 2 by being press-fitted in press-fit grooves 38 formed in side walls of a recessed portion 35, which is formed in one side end portion on the upper surface of the housing body 2.

As shown in FIG. 7, the upper metal piece 40 has a frame stationary portion 41 whose both side edges are press-fitted into the press-fit grooves 38 formed in the side walls of the recessed portion 35; a terminal portion 42 extending down from the frame stationary portion 41 and soldered to a contact pad of a printed circuit board; and a spring contact leaf 43 extending like a cantilever from one end of the frame stationary portion 41. A front end portion 44 of the spring contact leaf 43 is bent upward.

The lower metal piece 50 similarly has a frame stationary portion 51, a terminal portion 52, and a spring contact leaf 53 extending like a cantilever from one end of the frame stationary portion 51. The spring contact leaf 53 does not project down or up.

The frame stationary portions 41, 51 of the metal pieces 40, 50 are separated vertically and, in the normal state (before the ejection operation), the spring contact leaf 43, 53 are not contacted and the switch SW is off.

As the eject member 6 is moved in the direction of push operation C, as shown in FIG. 7, a switch pressing surface 36 formed at the front end of the eject member 6 pushes the front end portion 44 of the upper metal piece 40 to deflect the spring contact leaf 43 including the front end projection 44 downward (elastic deformation). As a result, the spring contact leaf 43 comes into contact with the spring contact leaf 53 of the lower metal piece 50, turning on the switch SW.

The structure of the switch SW is so set that immediately after the ejection button 5 is pressed for purpose of shifting from the OFF state to the ON state of the switch SW, the distance traveled by the eject member 6 is e.g. about 1 mm. That is, the switch pressing surface 36 of the eject member 6 is nearly in contact with the front end projection 44 of the upper metal piece 40 before the eject operation (strictly speaking, it is e.g. about 0.7 mm away from the front end projection 44). The switch SW turns on when the eject member 6 has traveled about 1 mm. After the switch SW turn on, the spring contact leaf 43 and the front end projection 44 of the upper metal piece 40 are continuously pressed downwardly by a bottom wall of a switch press portion 37 (see FIG. 7) of the eject member 6, so that until the eject member 6 returns to the initial position, the spring contact leaf 43 of the upper metal piece 40 is kept in contact with the spring contact leaf 53 of the lower metal piece 50, thus maintaining the ON state of the switch SW.

In the card ejection mechanism made up of the boss 12 of the eject member 6 and the cam lever 15 described above, the installation positions of the boss 12 and cam lever 15 and the length and direction of the slot 18 are so set that the ejection operation of the card 4 is initiated after the switch SW is turned on. For example, if the switch SW is turned on by the eject member 6 moving the distance of 1 mm, the card ejection mechanism is set so that the card eject operation is started, i.e., the boss 12 of the eject member 6 comes in contact with the force receiving portion 17 of the cam lever 15 when the eject member 6 has traveled a distance of about 4 mm.

Now, the card eject operation in the above connector will be explained by referring to the accompanying drawings FIG. 9A to FIG. 9F and FIG. 10 to FIG. 14. FIG. 9A to FIG. 9F show step-by-step the states of various portions during the card eject operation and the following explanations are based on FIG. 9A to FIG. 9F, in which the eject member 6 are shown upside down.

Figures 9A, 9B, 9C, 9D, 9E, 9F:
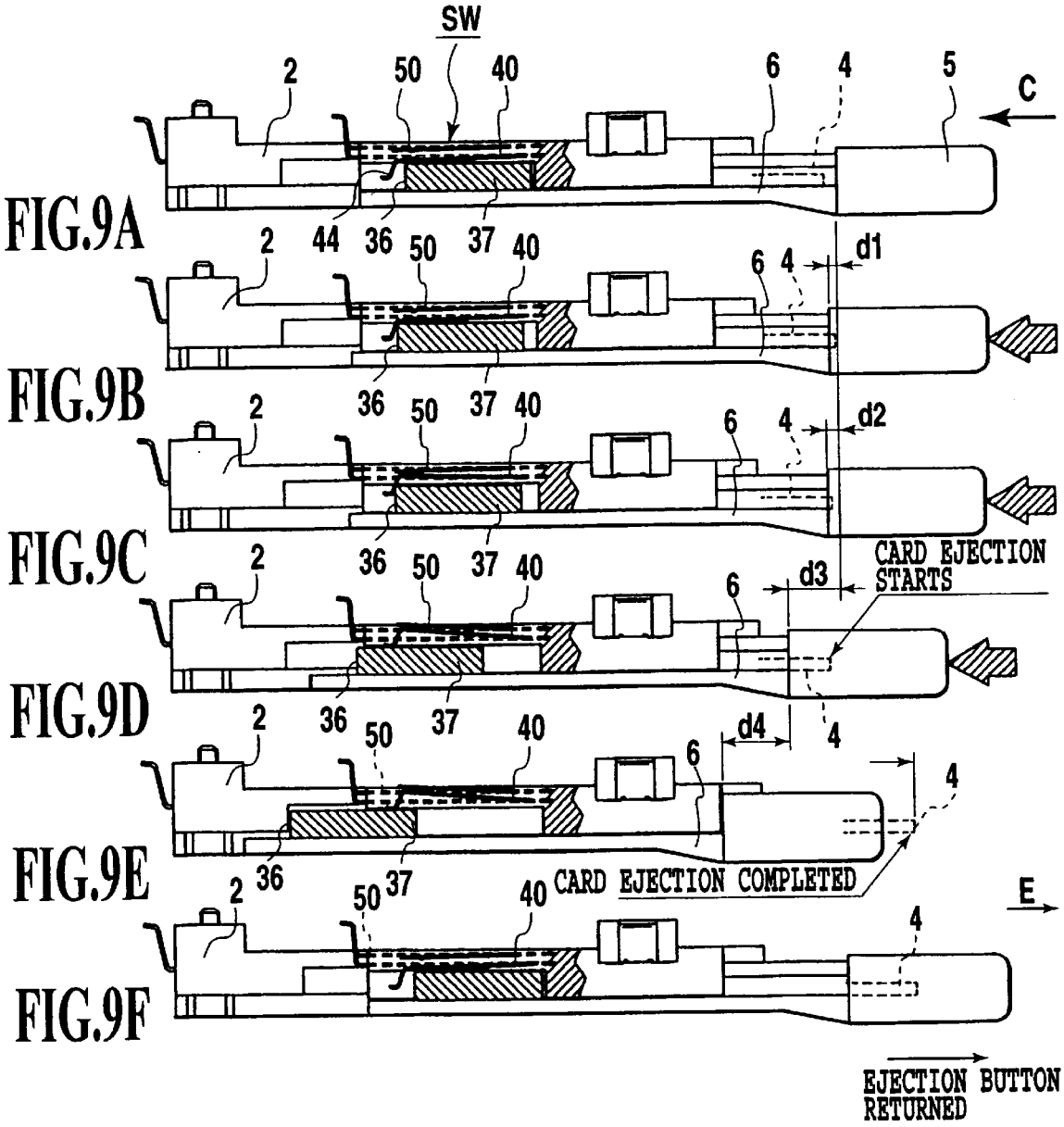
FIGS. 9A, 9B, 9C, 9D, 9E and 9F are cross sections showing changes in motion of various components during an eject operation, respectively.

FIG. 9A . . . State of the connector when the card is inserted

When the IC card 4 is inserted into the connector 1 from the card insertion opening 7, the card 4 is carried within by the slider 8. The projection 20 (see FIG. 11) formed on the underside of the slider 8 is inserted in the slot 18 of the cam lever 15, so that the movement of the slider 8 in the card insertion direction C causes the cam lever 15 to rotate about the shaft 14 and assume the position shown in FIG. 10.

Figure 10:
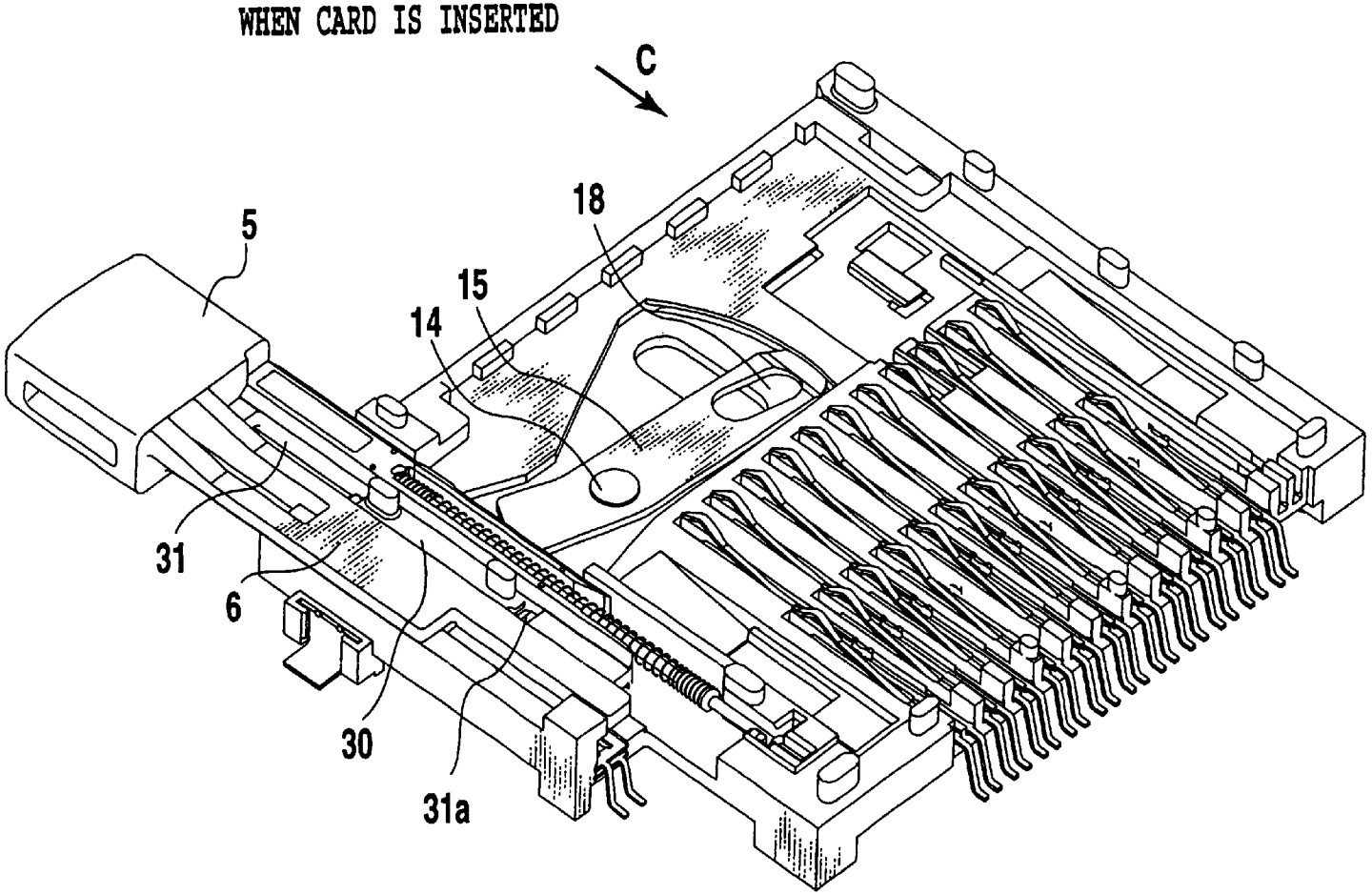
FIG. 10 is a perspective view showing a state of the card connector of FIG. 1 when a card is inserted.

When the card 4 is inserted, the eject member 6 is in an initial state before the eject operation where, as shown in FIG. 10, a front end wall surface 31*a* forming the guide slot 31 comes in contact with the stopper body 30 by the urging force of the coil spring 25 and the boss 12 projecting from the underside of the eject member 6 is away from the force receiving portion 17 of the cam lever 15. Hence, the eject member 6 is not involved in the ejection operation when the card is inserted.

Further, when the card is inserted, the eject operation detection switch SW is off.

FIG. 9B . . . State of the connector immediately after the ejection button is operated When the ejection button 5 is pressed, the eject member 6 starts moving. When the eject member 6 has moved a predetermined distance d1 (for example, about 0.7 mm), the switch pressing surface 36 of the switch press portion 37 of the eject member 6 comes in contact with the front end projection 44 of the upper metal piece 40.

FIG. 9C . . . State of the connector when the switch SW is turned on

When the ejection button 5 is further pushed and the eject member 6 moves by a predetermined distance d2 (for example, 1 mm) from the initial position, the spring contact leaf 43 of the upper metal piece 40 is elastically deformed downwardly by the switch press portion 37 of the eject member 6, coming into contact with the spring contact leaf 53 of the lower metal piece 50, turning on the switch SW. The ON state of this switch SW is detected by an eject operation detect circuit (not shown) electrically connected to the terminal portions 42, 52 of the metal pieces 40, 50.

Figure 11:
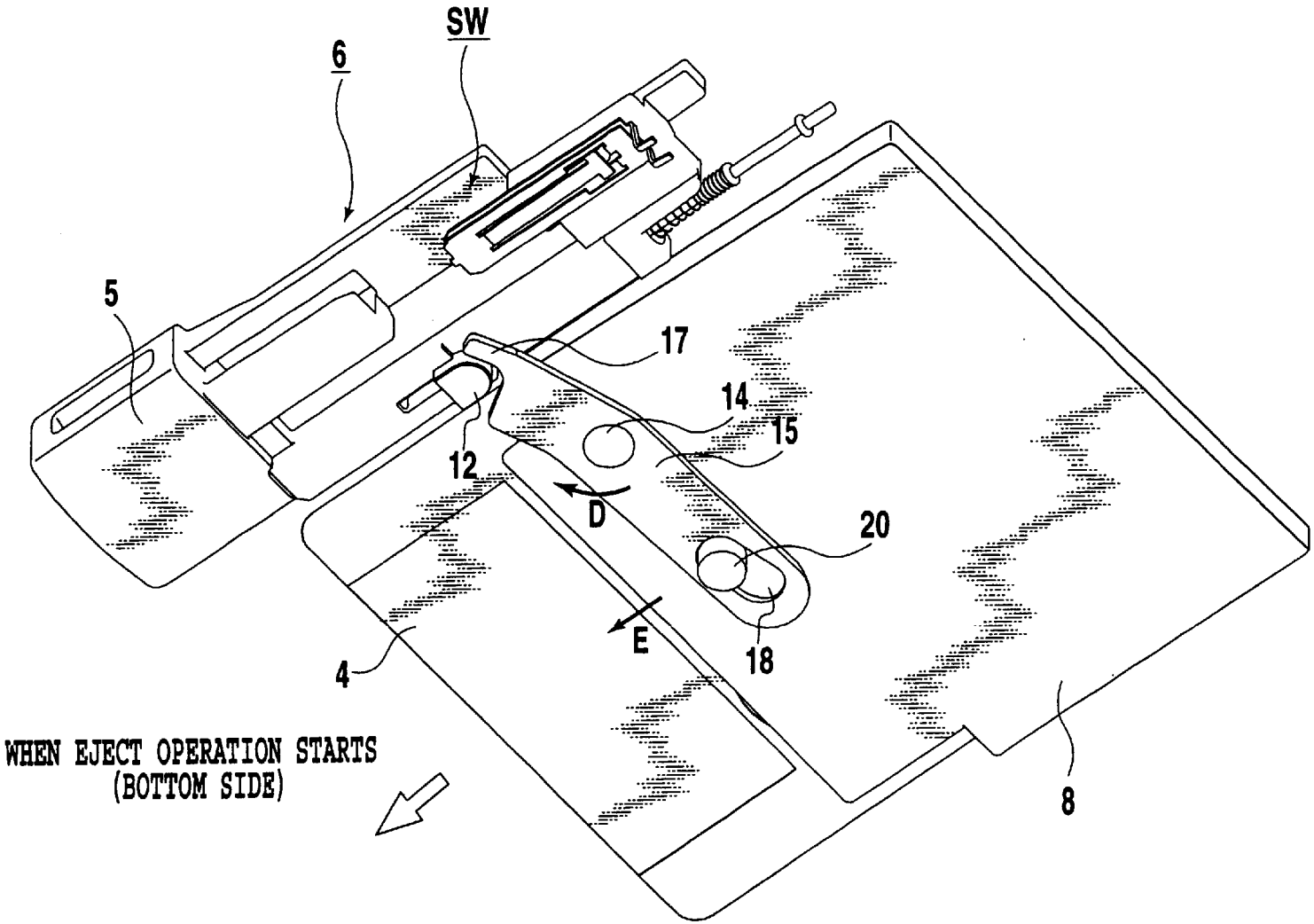
FIG. 11 is a perspective view showing a state of the card connector of FIG. 1 as seen from the back side when the eject operation is started.

FIG. 9D . . . State of the connector when the ejection mechanism start its operation The ejection button 5 is further pushed and the eject member 6 moves by a predetermined distance d3 (for example, 4 mm) from the initial position. This movement causes the boss 12 projecting from the underside of the eject member 6 to first come in contact with the force receiving portion 17 of the cam lever 15 (see FIG. 11). From this point the eject operation by the ejection mechanism starts. FIG. 11 shows the connector housing as seen from the bottom side and the housing body 2 and the like are not shown.

The switch SW remains turned on as the spring contact leaf 43 of the upper metal piece 40 continues to be pressed down by the bottom wall of the switch press portion 37 of the eject member 6.

After this, when the ejection button 5 is further pushed, the boss 12 presses against the force receiving portion 17 of the cam lever 15, causing the cam lever 15 to rotate about the shaft 14 in the direction of arrow D (FIG. 11). The rotation displacement of the cam lever 15 causes the slider 8 engaged in the slot 18 through its projection 20 to move in the ejecting direction E, thus discharging the card 4 carried on the slider 8 into the outside.

FIG. 9E . . . State of the connector when the eject operation is completed

Figure 12:
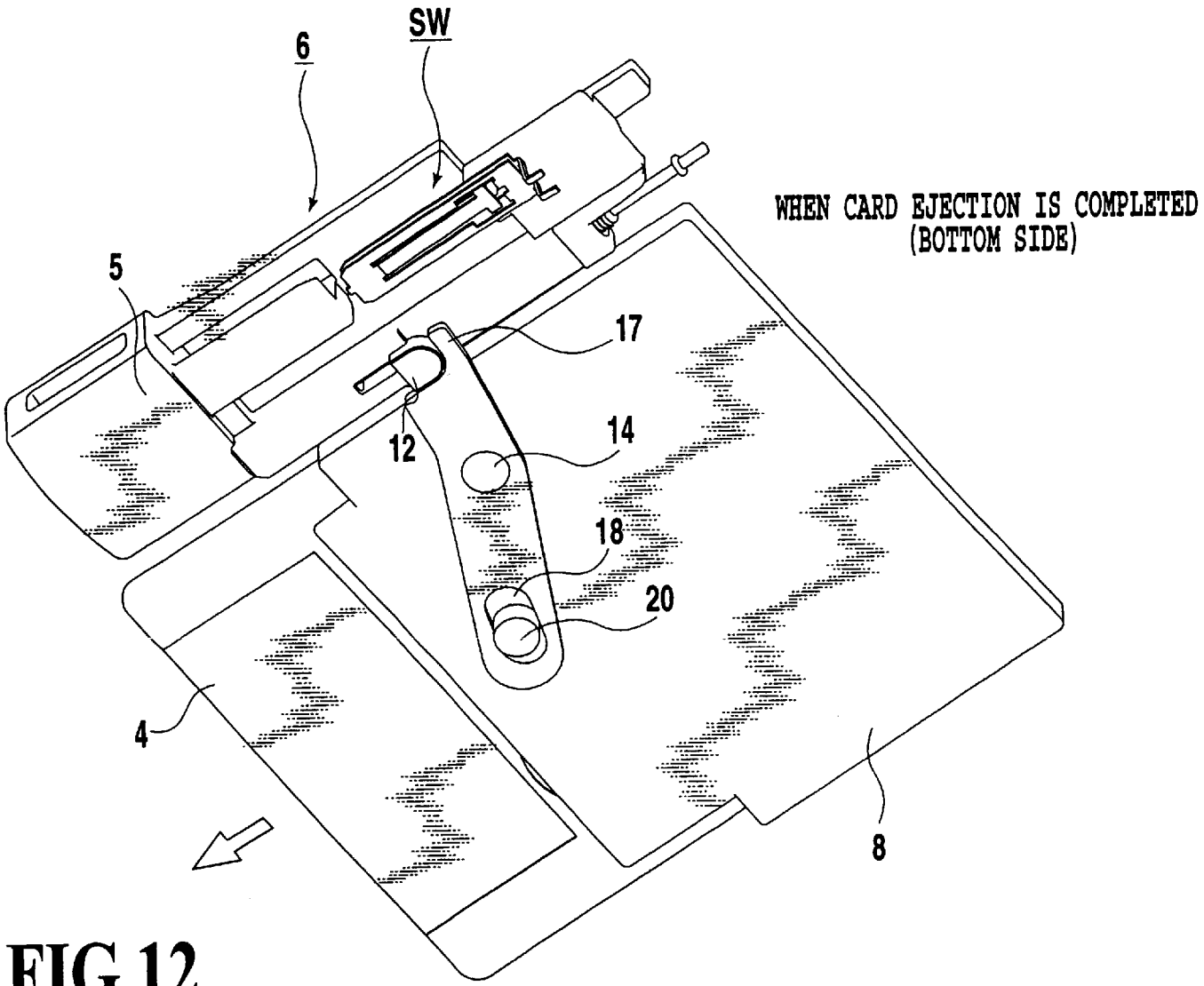
FIG. 12 is a perspective view showing a state of the card connector of FIG. 1 as seen from the back side when the eject operation is completed.
Figure 13:
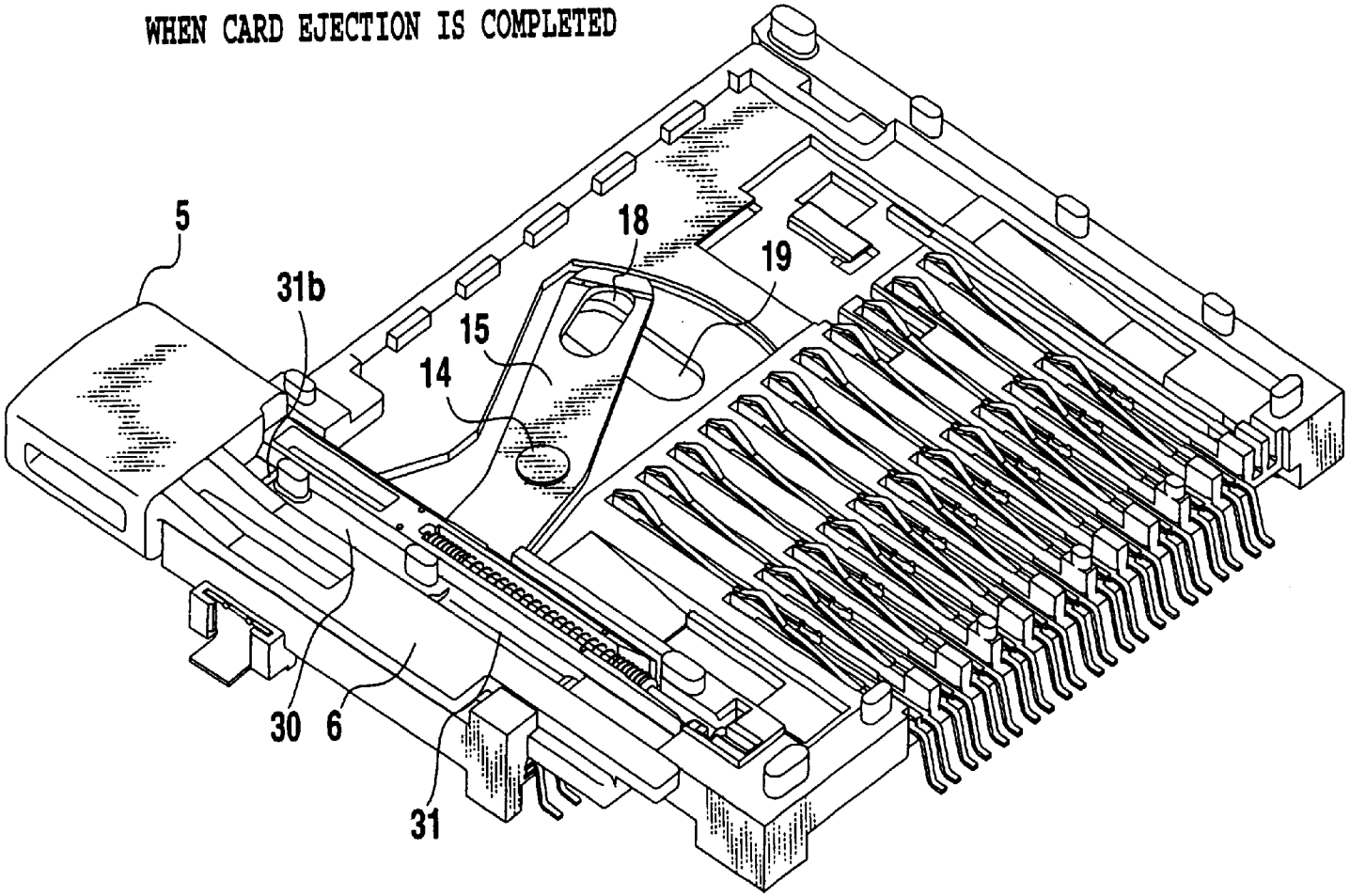
FIG. 13 is a perspective view showing a state of the card connector of FIG. 1 as seen from the front side when the eject operation is completed.

When the eject member 6 is further pushed and travels by a predetermined distance d4 (for example, 5 mm) from the operation start position of the ejection mechanism, a rear end wall surface 31*b* forming the guide slot 31 comes in contact with the stopper body 30, blocking a further advance of the eject member 6 in the push direction. At this point, the operation for ejecting the card 4 is completed and the card 4 comes to a stop. FIG. 12 and FIG. 13 show the connector as seen from the top and bottom sides when the eject operation is completed. In the state of FIG. 9E the switch SW remains turned on.

Figure 14:
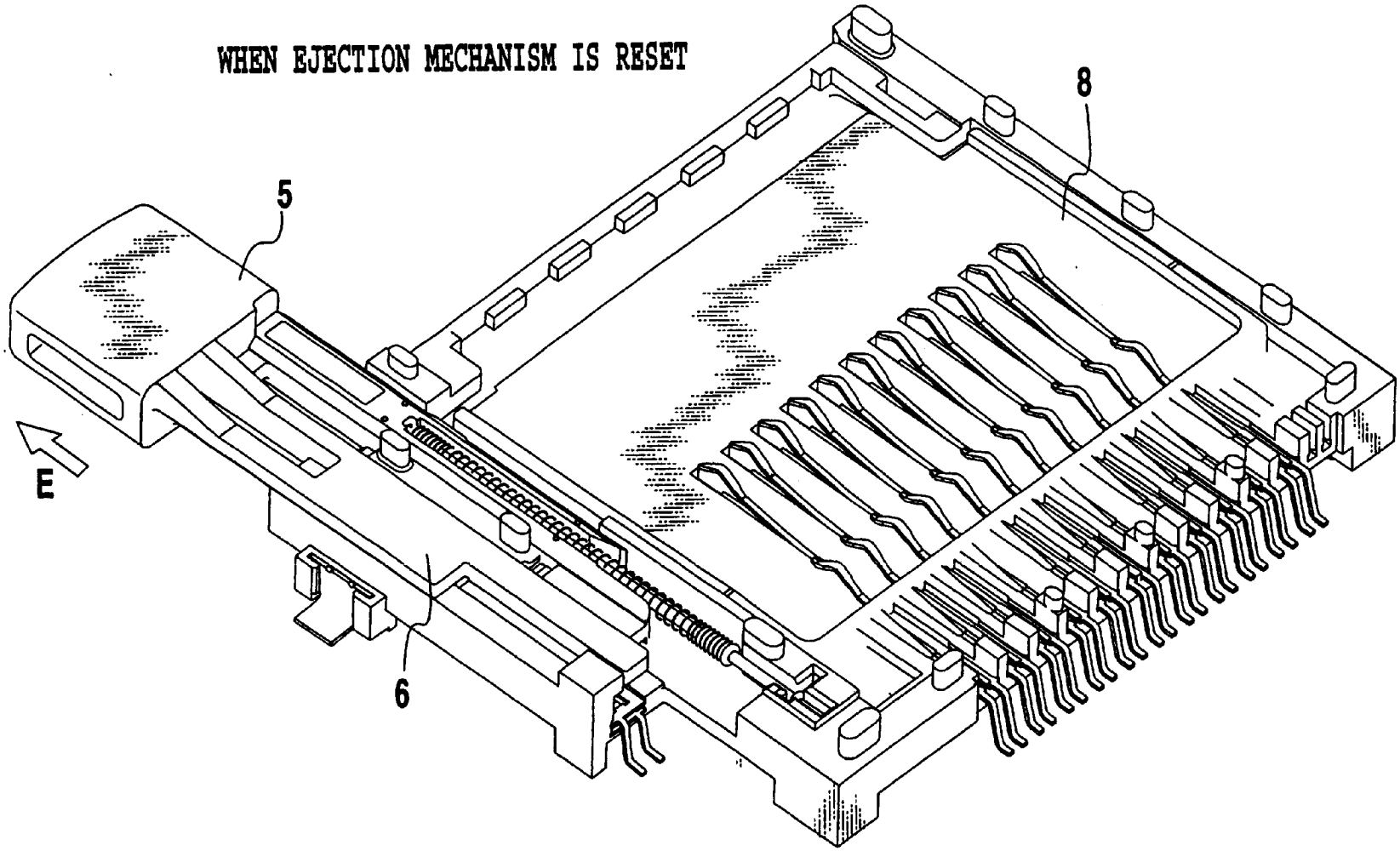
FIG. 14 is a perspective view showing a state of the card connector of FIG. 1 when the ejection button is automatically reset.

FIG. 9F . . . State of the connector when the ejection button is automatically reset When, after having been ensured that the card 4 is ejected, an operator releases the pressing force from the ejection button 5, the recovery force of the coil spring 25 resets the eject member 6 to the initial position, as shown in FIG. 14. When the eject member 6 almost returns to the initial position, the spring contacts 43, 53 of the metal pieces 40, 50 are parted each other, turning off the switch SW. As described above, with this card connector, in the period during which the eject member 6 has begun to be pushed and the boss 12 comes in contact with the cam lever 15 and the operation of the ejection mechanism starts, there is provided an idle travel period for the eject member 6, in which the eject operation detection switch SW made up of the two metal pieces 40, 50 is turned on. Hence, on the electronic device side it is possible to perform a control, such as predetermined error avoiding handling, according to a detection signal from the eject operation detection switch SW, thereby forestalling a card error that may occur when the ejection button 5 is erroneously operated. This precludes the possibility of loss of data being written into or read from the card.

Further, because the automatic reset mechanism utilizing the coil spring 25 automatically resets the ejection button 5 when not loaded, the ON/OFF switching of the eject operation detection switch SW does not take place unless the ejection button is pressed with a force. This prevents an erroneous operation of the switch.

Although, in the eject operation detection switch SW of the above embodiment, the idle travel of the eject member 6 before the ejection mechanism starts operation is detected by the contact and uncontact of the two metal pieces 40, 50, the detection method of this switch SW is arbitrary. For example, an optical sensor may be used. The primary function of the eject operation detection switch SW is to detect the state immediately after the ejection button 5 has started the pressing operation. Therefore, as long as the switch turns on before the ejection mechanism starts its operation, any desired detection method can be used.

While, in the above embodiment, the insertion and ejection of the card 4 is accomplished by moving the slider 8 that carries the card 4, it may be configured to directly insert and eject the card 4 into/from the connector housing.

Further, although the above embodiment employs the ejection mechanism using the cam lever, any other arrangement may be used in the ejection mechanism. The automatic reset mechanism of the ejection button 5 may use other kinds of spring than the coil spring 25 or other elastic members.

The present invention has been described in detail with respect to preferred embodiments, and it will now be apparent from the foregoing to those skilled in the art that changes and modifications may be made without departing from the invention in its broader aspects, and it is the intention, therefore, in the appended claims to cover all such changes and modifications as fall within the true spirit of the invention.

What is claimed is:

1. A card connector capable of removably supporting a card and, in response to a pressing operation of an ejection button, ejecting said card inserted in said connector, said card connector comprising:

eject operation detection switch configured to turn on immediately after said ejection button has begun to be pressed; and an eject operation mechanism configured to, in response to said pressing operation of said ejection button, start the operation of ejecting said card after said eject operation detection switch has turned on, wherein said eject operation detection switch is configured to turn on in an idle travel period which is provided for said eject operation mechanism, said idle travel period being a period after the pressing operation of said ejection button has been started and before said operation of ejecting said card by said eject operation mechanism starts.

2. A card connector according to claim 1, further including an automatic reset mechanism which automatically resets said ejection button when not loaded.

3. A card connector capable of removably supporting a card and, in response to a pressing operation of an ejection button, ejecting said card inserted in said connector, said card connector comprising:

an ejection operation mechanism configured to execute the operation of ejecting said card in response to the pressing operation of said ejection button; and an ejection operation detection switch configured to turn on in an idle travel period for said eject operation mechanism, said idle period being a period after the pressing operation of said ejection button has been started and before said operation of ejecting said card by said eject operation mechanism starts.

* * * * *